US008082863B2

(12) United States Patent
Kinoshita

(10) Patent No.: US 8,082,863 B2
(45) Date of Patent: Dec. 27, 2011

(54) PRESSER FOOT AND SEWING MACHINE

(75) Inventor: Ryuichiro Kinoshita, Toyonaka (JP)

(73) Assignee: Yamato Mishin Seizo Kabushiki Kaisha, Osaka (JP)

( * ) Notice: Subject to any disclaimer, the term of this patent is extended or adjusted under 35 U.S.C. 154(b) by 218 days.

(21) Appl. No.: 12/562,642

(22) Filed: Sep. 18, 2009

(65) Prior Publication Data

US 2010/0071604 A1 Mar. 25, 2010

(30) Foreign Application Priority Data

Sep. 19, 2008 (JP) ..... 2008-241581

(51) Int. Cl.
*D05B 29/00* (2006.01)

(52) U.S. Cl. ..... 112/235

(58) Field of Classification Search ..... 112/235, 112/151, 122, 126, 127, 128, 129, 240
See application file for complete search history.

(56) References Cited

U.S. PATENT DOCUMENTS 2,915,996 A * 12/1959 Charest ..... 112/122
4,526,113 A * 7/1985 Angele ..... 112/127
5,205,231 A 4/1993 Sanvito et al.
5,370,071 A * 12/1994 Ackermann ..... 112/142
5,960,729 A * 10/1999 Matsumoto et al. ..... 112/235
6,443,080 B1 * 9/2002 Matsumoto et al. ..... 112/235

FOREIGN PATENT DOCUMENTS

JP 59-34457 U 9/1984
JP 5-96074 A 4/1993
JP 2003-305287 A 10/2003
JP 2008-161542 A 7/2008

* cited by examiner

*Primary Examiner* — Tejash Patel

(74) *Attorney, Agent, or Firm* — Birch, Stewart, Kolasch & Birch, LLP

(57) ABSTRACT

In a presser foot and a sewing machine according to the present invention, a guide hole is formed in a presser leg to which a fixed knife is attached, so as to passing through the presser leg up and down, and a knife holder is fitted and held to the guide hole. The fixed knife is inserted to a retention groove provided in a peripheral surface of the knife holder through a window hole provided in the presser leg, and is fixed by fastening a stop screw. A position of the fixed knife is adjusted in a vertical direction by moving the knife holder in the vertical direction along the guide hole and fastening the stop screw at an appropriate position, thereby changing a cut position of ends of fabrics and changing an overlapped width of the fabrics at a time of seaming.

7 Claims, 7 Drawing Sheets

PRESSER FOOT AND SEWING MACHINE

CROSS-REFERENCE TO RELATED APPLICATIONS

This Nonprovisional application claims priority under 35 U.S.C. §119(a) on Patent Application No. 2008-241581 filed in Japan on Sep. 19.2008, the entire contents of which are hereby incorporated by reference.

BACKGROUND

1. Technical Field

The present invention relates to a presser foot of a sewing machine which is used for seaming two fabrics while overlapping ends of the two fabrics over a predetermined width, and a sewing machine provided with the presser foot.

2. Description of Related Art

For example, the seaming of a crotch portion of a brief and shorts is executed by using a sewing machine provided with a narrow tubular bed. The seaming is executed in accordance with a procedure of overlapping up and down two fabrics inserted through the tubular bed over a predetermined width from edges of respective ends, feeding them to a needle drop position while pinching them between a needle plate provided in an upper surface of the tubular bed and a presser foot moving down onto the needle plate, and seaming them by a needle moving down to the needle drop position.

In order to execute the seaming properly, it is important to keep the overlapped width of the fabrics to be fed to the needle drop position proper. A sewing machine described in Examined Japanese utility Model Publication No. 59-344577 (1984) is provided with a special presser foot having a knife portion cutting ends of fabrics to be seamed and a guide portion (an upper guide and a lower guide) guiding the fabrics cut by the knife portion and overlapping them up and down.

FIG. 1 is a perspective view showing the vicinity of a needle drop position of a conventional sewing machine provided with the presser foot having the knife portion and guide portion. As shown in FIG. 1, a presser foot 1 is attached to a lower end of a presser bar 10 which is supported by an end portion of a sewing machine arm 2. The presser foot 1 is provided with a presser body 11 fixed to the lower end of the presser bar 10, and two presser legs 12 and 13 continuously provided on a front side of the presser body 11 and extending forward in parallel to each other.

The presser bar 10 is moved down, for example, in accordance with a manual operation. The presser foot 1 moves down in accordance with a downward movement of the presser bar 10, and elastically comes into contact with a needle plate 4 provided on a tubular bed 3. Two fabrics to be seamed (a lower fabric KL and an upper fabric KU) are set in a state where one fabric is pinched between the left presser leg 12 and the needle plate 4, and the other fabric is pinched between the right presser leg 13 and the needle plate 4. The fabrics are fed in a direction shown by an outline arrow in FIG. 1 with an operation of a known feed dog (not shown) repeatedly projecting from the needle plate 4, and are seamed by a plurality of (four in FIG. 1) needles 5, 5, . . . moving down through a needle hole 14 provided approximately in the center of the presser body 11.

Between the left and right presser legs 12 and 13, a guide passage 15 which is open to front ends of the presser legs is formed. In a halfway portion of the guide passage 15, there are arranged a fixed knife 6 which is fixed to the left presser leg 12, and a movable knife 7 which is held by the right presser leg 13 and reciprocates in a lateral direction by a power transmission from an inner portion of the sewing machine arm 2. The lower fabric KL and the upper fabric KU are led to the guide passage 15 in a state where the respective ends are risen and are aligned with each other on the needle plate 4, as illustrated in FIG. 1. The ends of the lower fabric KL and the upper fabric KU reach a position where the fixed knife 6 and the movable knife 7 are arranged, and are cut by a motion of the movable knife 7 which comes into slidable contact with the upper portion of the fixed knife 6 while overlapping with it.

An upper guide 16 is horizontally bridged between the upper surfaces of the left and right presser legs 12 and 13, on the rear sides of the fixed knife 6 and the movable knife 7, and a lower guide 17 (refer to FIGS. 2B and 2C) protruding into the guide passage 15 along the lower surface of the presser leg 12 is provided. The lower fabric KL and the upper fabric KU in which the upper ends are cut by the fixed knife 6 and the movable knife 7 are overlapped up and down according to an undermentioned action of the upper guide 16 and the lower guide 17, and are fed to downward positions (the needle drop positions) of the needles 5, 5, . . . .

FIGS. 2A to 2E are views for explaining a motion of the presser foot 1, and they schematically show cross sections of the presser foot 1 in a direction which is orthogonal to a direction where the lower fabric KL and the upper fabric KU are fed. FIG. 2A shows a cross section in the vicinity of the front end of the presser foot 1, FIG. 2B shows a cross section at positions where the fixed knife 6 and the movable knife 7 are arranged, FIG. 2E shows a cross section at the needle drop position, and FIGS. 2C and 2D show cross sections between the cut position and the needle drop position, respectively.

As shown in FIGS. 2C and 2D, the upper guide 16 has a lower surface which is curved in an arch shape, and is provided in such a manner as to increase its thickness toward a rear side and be continuous with the lower surface of the presser body 11. As shown in FIGS. 2B and 2C, the lower guide 17 is a plate fixed to the lower surface of the presser leg 12, and is provided in such a manner as to increase its length protruding into the guide passage 15 from just after the arrangement positions of the fixed knife 6 and the movable knife 7 toward the rear side.

The lower fabric KL and the upper fabric KU are overlapped over an appropriate width from edges of the respective ends, and are led to the guide passage 15 in a state where the overlapped portions are risen on the needle plate 4, as shown in FIG. 2A. The led lower fabric KL and upper fabric KU reach the slidable contact position between the fixed knife 6 and the movable knife 7, as shown in FIG. 2B, and the ends of the fabrics are cut, and then the fabrics are fed to the rear side as shown in FIGS. 2C and 2D.

During the feeding, the lower fabric KL pressed by the left presser leg 12 is pressed from the left side according to an action of the lower guide 17 protruding into the guide passage 15, and falls along the upper surface of the needle plate 4. The upper fabric KU pressed by the right presser leg 13 is guided by the arch shaped lower surface of the upper guide 16, falls on the lower guide 17, and is overlapped with the upper portion of the lower fabric KL on the needle plate 4 at a terminal end of the lower guide 17. In this state, the lower fabric KL and the upper fabric KU are fed to the needle drop position, and are seamed by the needles 5, 5, . . . moving down to the needle hole 14, as shown in FIG. 2E.

In the sewing machine provided with the presser foot 1 as mentioned above, the lower fabric KL and the upper fabric KU have ends being cut according to the motions of the fixed knife 6 and the movable knife 7, are overlapped up and down according to the actions of the upper guide 16 and the lower guide 17, are fed to the needle drop position, and are seamed in a fixed overlapped width. A worker may appropriately overlap the lower fabric KL and the upper fabric KU, and set the fabrics raised on the needle plate 4 at the front position of the presser foot 1. Accordingly, it is not necessary to finely adjust the overlapped width by a manual operation, and it is possible to seam the fabrics at a high efficiency.

FIGS. 3A to 3C are perspective views showing seams formed by the seaming as seen from a front face side of the fabric. FIG. 3A shows a satisfactory seam. This seam is a mode in which sewing lines formed with four needle threads 50, 50, . . . are lined within a range of the overlapped width on the front faces of the lower fabric KL and the upper fabric KU overlapping from edges of the respective ends over the predetermined width, and a topping thread 51 regularly intertwines with these sewing lines.

In the case of using the above-mentioned presser foot 1, since the lower fabric KL and the upper fabric KU are overlapped, and cut according to the motions of the fixed knife 6 and the movable knife 7, it is possible to set the overlapped width in conformity to the lined width of four needles 5, 5, . . . , and it is possible to form the satisfactory seam shown in FIG. 3A.

However, in the actual sewing, as shown in FIG. 3B, there is a case where the sewing lines on both sides protrude to outer sides of the edges of the lower fabric KL and the upper fabric KU, thereby forming a defective seam. Inversely there is a case where the sewing lines on both sides are positioned in inner sides of the edges of the lower fabric KL and the upper fabric KU away from the edges, thereby forming a defective seam.

In a case where the seam shown in FIG. 3B is formed, only two sewing lines are positioned among four sewing lines made of the needle threads 50, 50, . . . in a portion where the lower fabric KL and the upper fabric KU are overlapped, and there is a problem that a sewing strength comes short. In a case where the seam shown in FIG. 3C is formed, any problem in terms of the strength does not occur, however, in the case where the sewing machine is used for seaming the crotch portion of the brief and the shorts, as mentioned above, the ends of the lower fabric KL and the upper fabric KU which are extra in the outer sides of the sewing lines on both sides come into contact with the skin at a time of wearing the seamed product, and there is a problem that a use feeling is deteriorated.

The inventor of the present application searched about a case example where the defective seam as mentioned above occurs, and found that a cause of the defective seam exists in a kind of the fabric to be seamed.

For example, in the case of sewing a stretchable fabric, the lower fabric KL and the upper fabric KU are cut by the fixed knife 6 and the movable knife 7 in a state where both the fabrics KL and KU are stretched, and the thereafter overlapping is carried out in a state where the lower fabric KL and the upper fabric KU are contracted. In this case, the overlapped width comes short, and the sewing defect as shown in FIG. 3B occurs.

On the contrary, for example, in the case of sewing a soft fabric, the lower fabric KL and the upper fabric KU rise in a state where they are deflected on the needle plate 4, and they are cut by the fixed knife 6 and the movable knife 7 in this state. In this case, the overlapped width of the lower fabric KL and the upper fabric KU becomes too large, and the sewing defect as shown in FIG. 3C occurs.

In order to deal with the above-mentioned problem, there can be considered a way of preparing a plurality of kinds of presser foots 1 in which height positions of the fixed knife 6 and the movable knife 7 are different, and exchanging the presser foot according to the fabrics to be seamed, however, there is a problem that a great deal of work is necessary for exchanging the presser foot, and a working efficiency is lowered.

SUMMARY

The present invention has been made with the aim of solving the above problems, and it is an object of the present invention to provide a presser foot capable of adjusting a cut position of ends of fabrics with a simple operation from outside, and changing an overlapped width of the fabrics at a time of seaming, and to provide a sewing machine capable of always seaming the fabric properly regardless of the kind of the fabric by providing the presser foot.

A presser foot according to a first aspect of the present invention is a presser foot of a sewing machine comprising: two presser legs provided on lateral sides of a needle drop position of the sewing machine, and pressing a fabric on a needle plate from above; a fixed knife attached to one presser leg; a movable knife held by the other presser leg and reciprocating while slidably coming into contact with an upper portion of the fixed knife; and a position adjusting unit adjusting an attached position of the fixed knife in a vertical direction, wherein the presser foot cuts an end of the fabric rising on the needle plate and being led between the two presser legs at a contact position between the movable knife and the fixed knife.

In the present invention, the vertical position of the fixed knife attached to one presser leg is adjusted by the position adjusting unit. In accordance with this adjustment, the height positions of the fixed knife and the movable knife change on the needle plate in the slidable contact portion, the height of the fabrics cut in the slidable contact portion changes, and it is possible to adjust the overlapped width of the fabrics.

A presser foot according to a second aspect of the present invention is characterized in that the presser foot as recited in the first aspect is provided with: a guide hole passing through the one presser leg in a vertical direction thereof; a knife holder holding the fixed knife and slidably fitted in the guide hole; and a stop screw fixing the knife holder at a desired position of the guide hole.

In the present invention, the fixed knife is held by the knife holder which is slidably fitted to the guide hole provided in the presser leg. The vertical position of the fixed knife can be adjusted with a simple operation of moving the knife holder along the guide hole and fixing the knife holder at an approximate position by the stop screw.

A sewing machine according to a third aspect of the present invention is a sewing machine used for feeding two fabrics to a needle drop position on a sewing machine bed while overlapping up and down from respective ends of the fabrics over a predetermined width, and seaming the fabrics, comprising: a needle plate provided on the sewing machine bed; and the presser foot as recited in the first or second aspect for pinching the fabrics with the needle plate.

In this invention, it is possible to achieve the seaming in a proper overlapped width regardless of the kind of the fabric, by using the presser foot capable of adjusting the cut position of the ends of the fabrics.

The above and further objects and features of the invention will more fully be apparent from the following detailed description with accompanying drawings.

DETAILED DESCRIPTION

Figure 4:
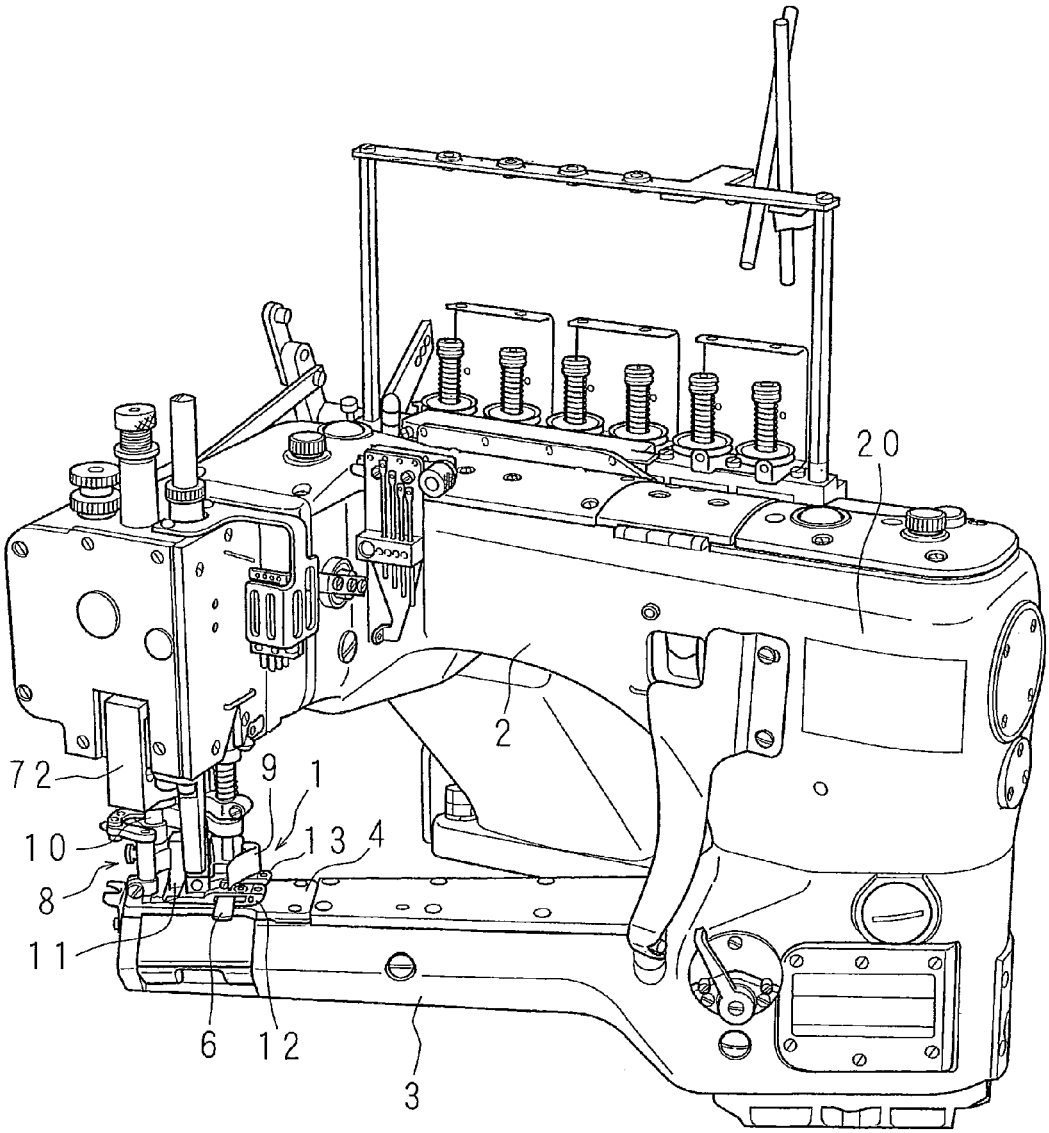
FIG. 4 is a perspective view showing a sewing machine provided with a presser foot according to the present invention.

The following description will explain in detail the present invention, based on the drawings illustrating a preferable embodiment thereof. FIG. 4 is a perspective view showing a whole structure of a sewing machine provided with a presser foot according to the present invention.

The illustrated sewing machine is a feed-off-arm sewing machine for a flat seaming, including a sewing machine arm 2 extending in one direction in an upper portion of a sewing machine frame 20, and a narrow tubular bed 3 (sewing machine bed) extending in a direction different from that of the sewing machine arm 2 in a lower portion of the sewing machine frame 20. A leading end portion of the sewing machine arm 2 is bent approximately perpendicularly so as to be opposed to an upper surface of a leading end portion of the tubular bed 3.

A presser bar 10 is supported by the leading end portion of the sewing machine arm 2. A lower end of the presser bar 10 protrudes from a lower side of the sewing machine arm 2 toward the tubular bed 3, and the presser foot 1 according to the present invention is attached to the lower end portion of the presser bar 10. The presser bar 10 is supported so as to be movable up and down. The presser foot 1 moves down according to a downward movement of the presser bar 10, elastically comes into contact with a needle plate 4 which is provided in the upper surface of leading end portion of tubular bed 3, and pinches the fabrics (not shown) with the needle plate 4.

The fabrics pinched between the presser foot 1 and the needle plate 4 are fed toward the leading end portion from a base portion of the tubular bed 3, with an operation of a feed mechanism (not shown) provided in an inner portion of the tubular bed 3, and are seamed by a plurality of needles (not shown) moving up and down in synchronization with the feeding.

Figure 1:
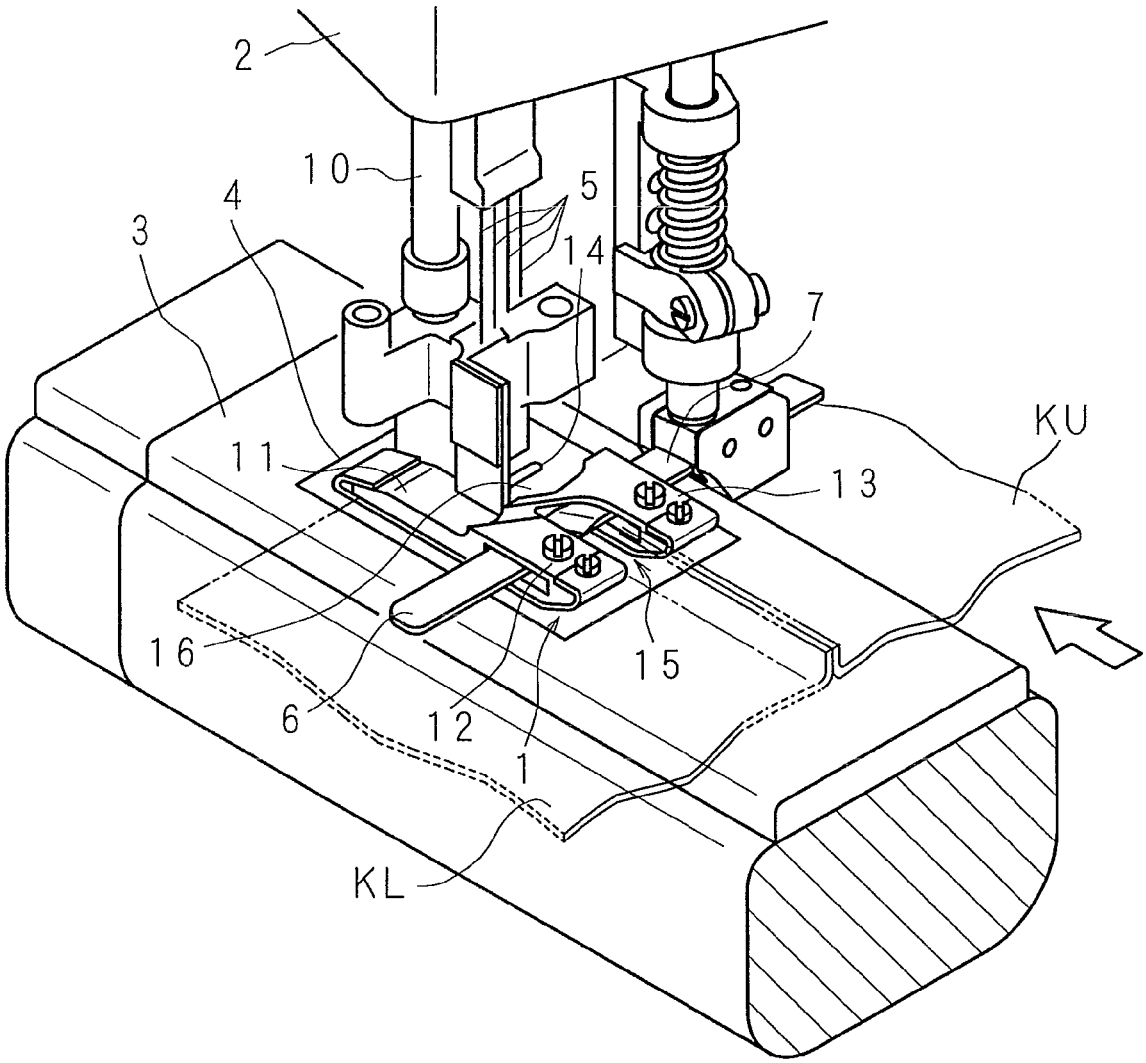
FIG. 1 RELATED ART
FIG. 1 is a perspective view showing the vicinity of a needle drop position of a conventional sewing machine.
Figure 2A:
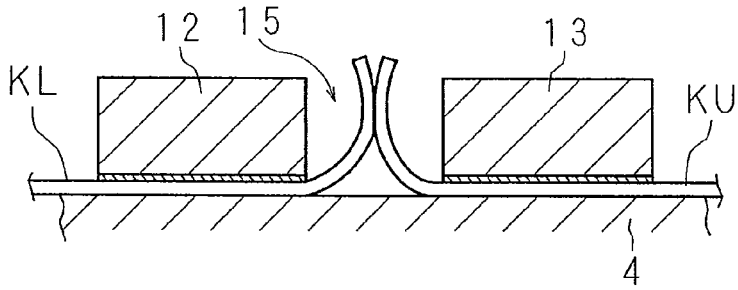
FIG. 2A RELATED ART
FIGS. 2A to 2E are views explaining a motion of a presser foot provided in the conventional sewing machine.
Figure 2B:
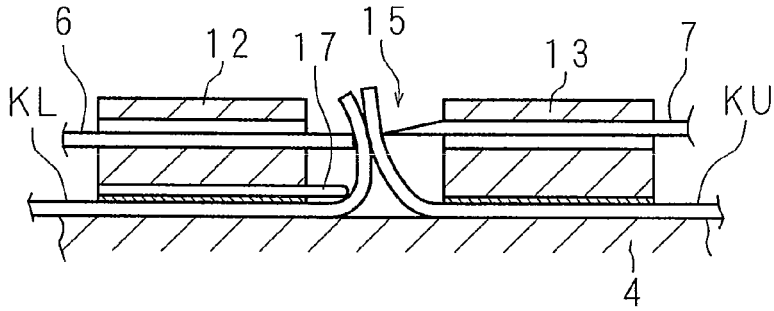
FIG. 2B RELATED ART
Figure 2C:
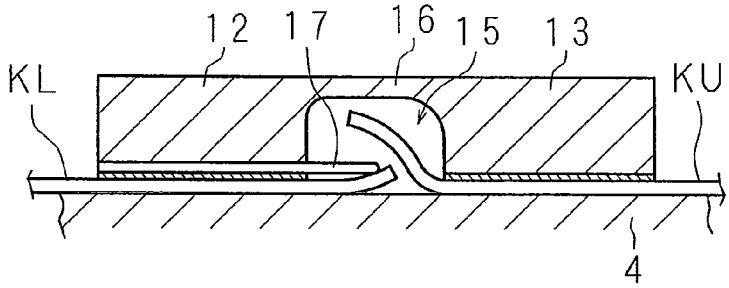
FIG. 2C RELATED ART
Figure 2D:
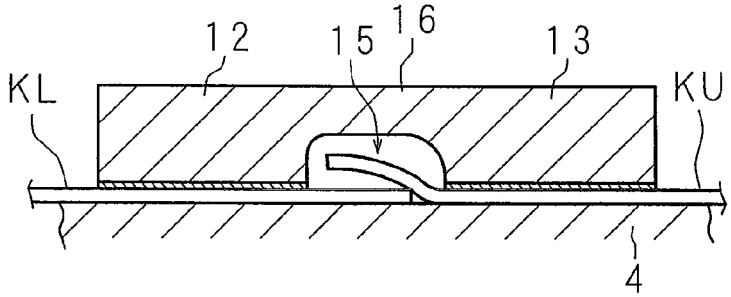
FIG. 2D RELATED ART
Figure 2E:
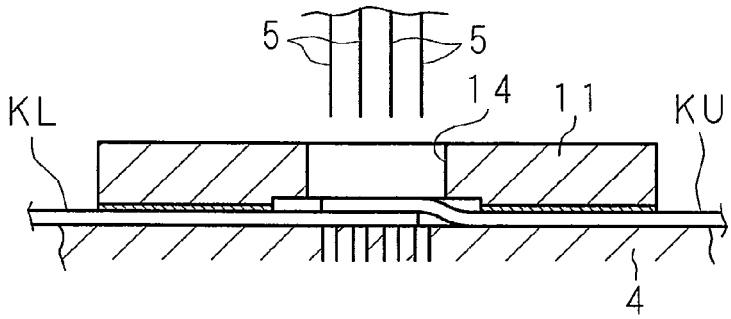
FIG. 2E RELATED ART

The presser foot 1 shown in FIG. 4 is provided with a pair of left and right presser legs 12 and 13 extending toward the base portion of the tubular bed 3 (a side of leading the fabric) in a front portion of a presser body 11 attached to the lower end of the presser bar 10, in the same manner as the conventional presser foot 1 shown in FIG. 1. The presser legs 12 and 13 are equipped with a knife mechanism having a fixed knife 6 and a movable knife 7 (refer to FIGS. 5 and 6).

The fixed knife 6 is a plate-shaped knife attached to the one presser leg 12 as mentioned below. In FIG. 4, only a base portion of the fixed knife 6 is illustrated. The movable knife 7 is a plate-shaped knife held by the other presser leg 13. The movable knife 7 reciprocates in a lateral direction (a direction which is approximately orthogonal to the presser legs 12 and 13) by a power transmission from the inner portion of the sewing machine arm slidably comes into contact with a leading end of the fixed knife 6 protruding between the presser legs 12 and 13, and cuts the ends of the fabrics led between the presser legs 12 and 13 in a state where the fabrics are aligned with each other as mentioned above. The cut fabrics are overlapped up and down by an action of a guide portion positioned on a downstream side of the knife mechanism, are fed to the needle drop position, and are seamed. A structure and an action of the guide portion are the same as those of the guide portion of the conventional presser foot 1 shown in FIG. 1 and FIGS. 2A to 2E, a detailed description thereof will not be given.

Figure 5:
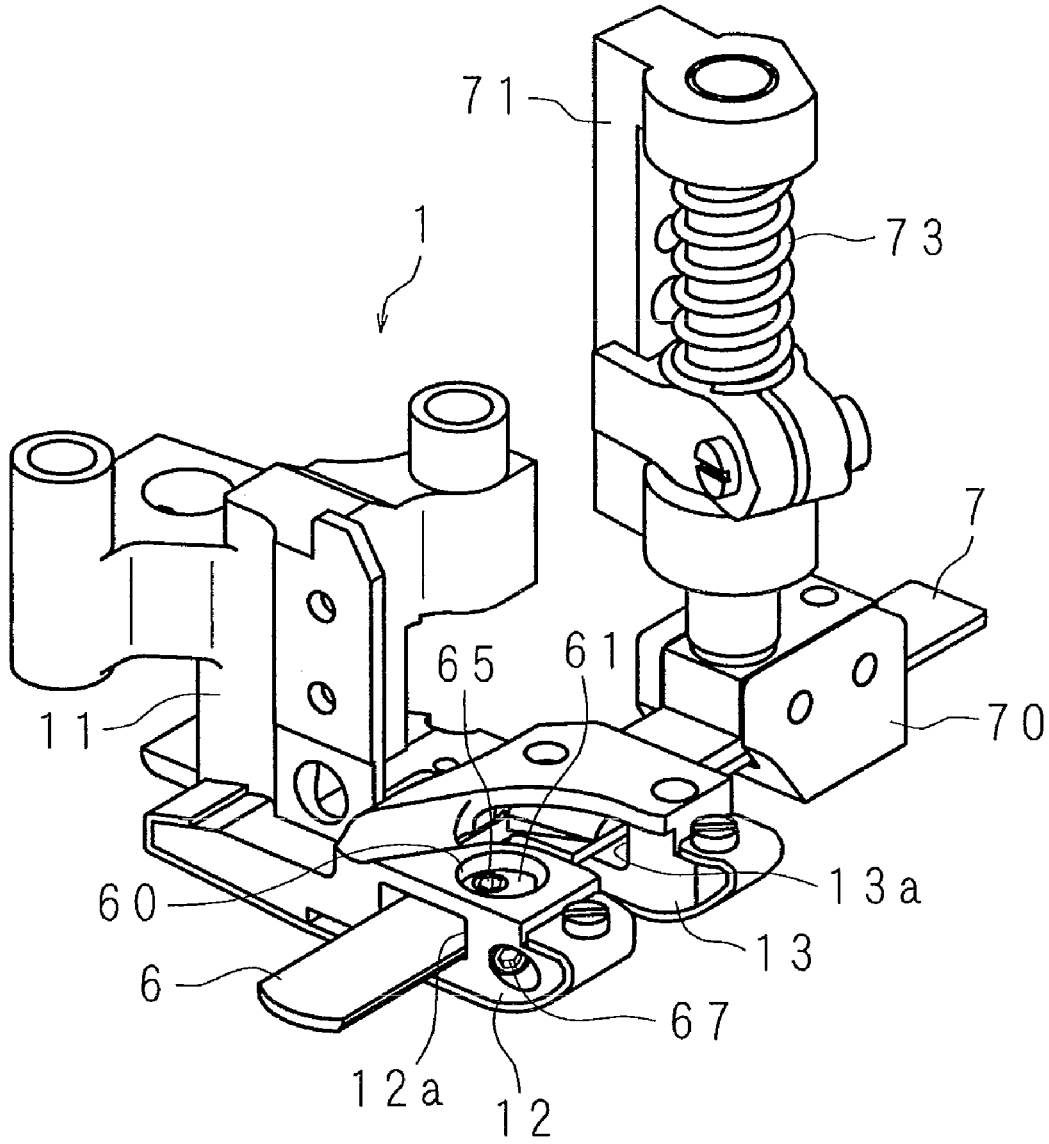
FIG. 5 is a perspective view showing a state where the presser foot according to the present invention is assembled.
Figure 6:
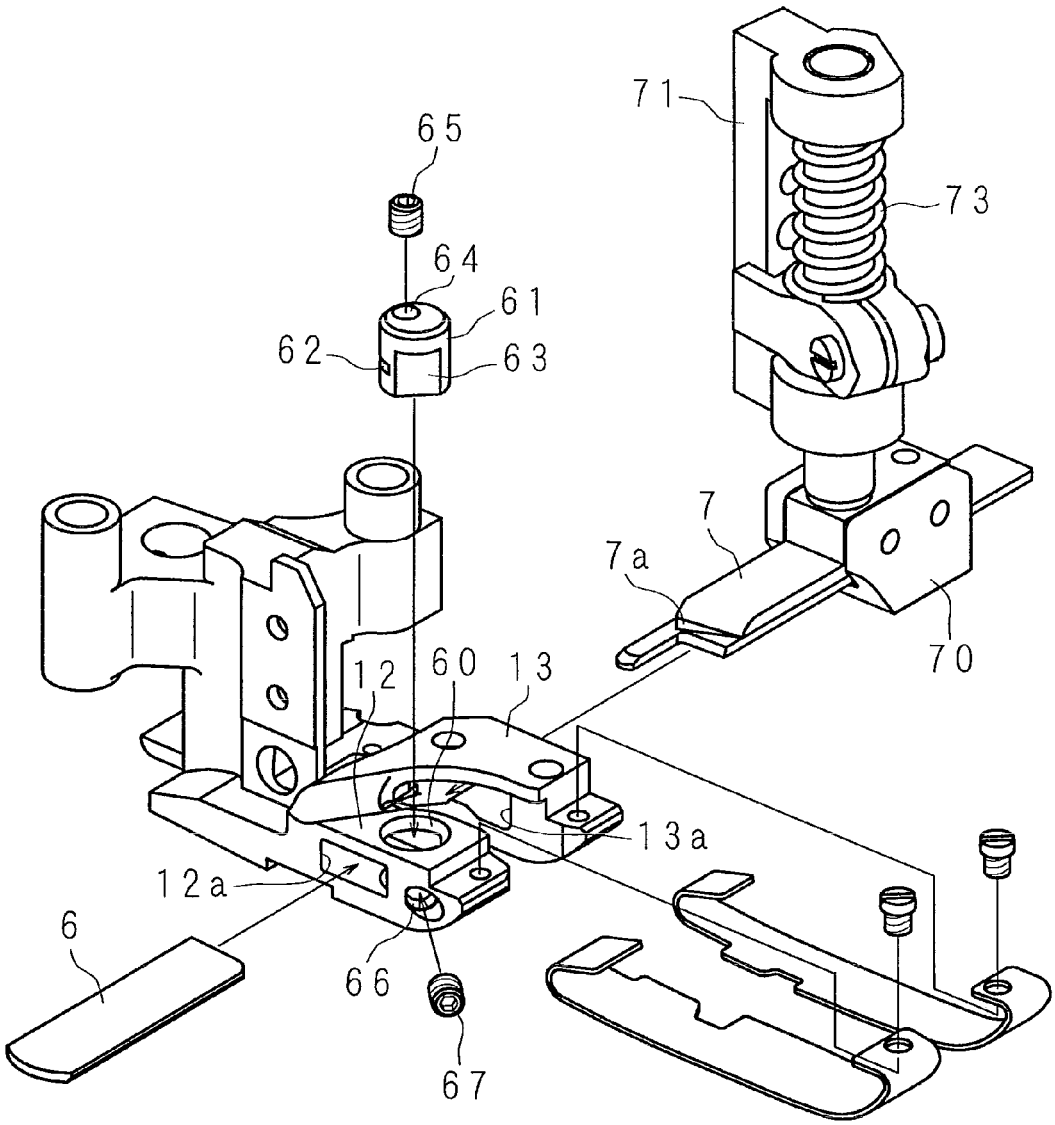
FIG. 6 is an exploded perspective view of the presser foot according to the present invention.

FIG. 5 is a perspective view showing a state where the presser foot 1 according to the present invention is assembled, and FIG. 6 is an exploded perspective view showing the presser foot 1 according to the present invention. Note that a fancy yarn mechanism 8 is constructed as shown in FIG. 4 in an upper portion of the presser body 11 of the presser foot 1, and a guide plate 9 curved in a circular arc shape toward the left presser leg 12 is attached to an upper surface of a leading end portion of the right presser leg 13, however, an illustration of the fancy yarn mechanism 8 and the guide plate 9 is not given in FIGS. 5 and 6.

Figure 3A:
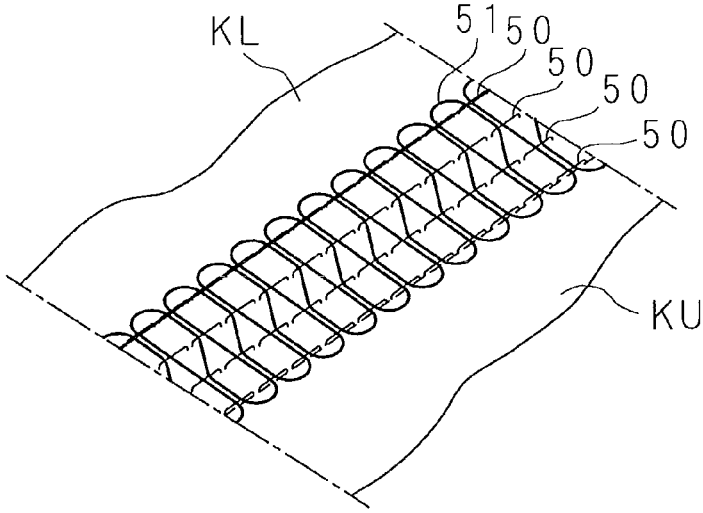
FIGS. 3A to 3C are perspective views showing a seam formed by seaming as seen from a front face side of fabrics, respectively.
Figure 3B:
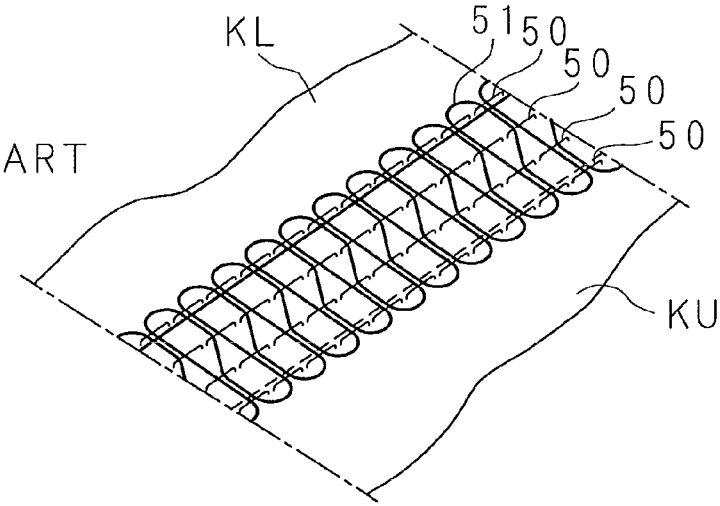
FIG. 3B RELATED ART
Figure 3C:
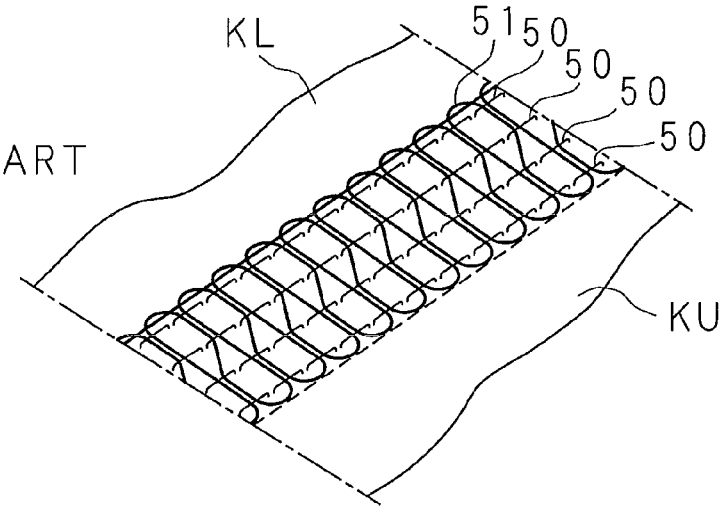
FIG. 3C RELATED ART

The fancy yarn mechanism 8 distributes an upper fancy yarn 51 (refer to FIGS. 3A to 3C) on an upper face of the fabric under being seamed, by a power transmission from the inner portion of the sewing machine arm 2. The guide plate 9 is provided for catching cut pieces of the fabrics cut by the fixed knife 6 and the movable knife 7, feeding them to the side of the left presser leg 12 along the curve thereof, and preventing them from reaching the needle drop position.

As shown in FIGS. 5 and 6, the left and right presser legs 12 and 13 have window holes 12*a* and 13*a* which are provided in side faces of respective halfway portions. The window holes 12*a* and 13*a* are holes which are rectangular on cross section and pass through the respective presser legs 12 and 13 in a width direction thereof. The left presser leg 12 is further provided with a guide hole 60. The guide hole 60 is a through hole which is circular on cross section and passes through the presser leg 12 in a vertical direction, and the guide hole is provided at a position facing a front portion of the window hole 12*a*. A knife holder 61 is fitted and held to the guide hole 60.

As shown in FIG. 6, the knife holder 61 is a short cylindrical body (tubular body) having an outer diameter enabling to fit the knife holder into the guide hole 60. The knife holder 61 has a peripheral surface formed of a retention groove 62 having a width corresponding to a thickness of the fixed knife 6 and being provided approximately in the center portion in an axial direction of the knife holder 61, and a flat portion 63 being provided at a position in a peripheral direction of the knife holder 61 which does not overlap the retention groove 62. The flat portion 63 is a portion obtained by flattening the peripheral surface of the knife holder 61 over an appropriate width, and is formed over a length in an axial direction from a lower end of the knife holder 61 to the vicinity of an upper end portion thereof.

Further, the knife holder 61 has a thread hole 64 having an opening in an upper end surface thereof and reaching the retention groove 62. On the other hand, the presser leg 12 has a thread hole 66 diagonally passing through the presser leg 12 toward the guide hole 60 from the forward side in an outer surface thereof, as shown in FIG. 6. A stop screw 65 is screwed into the thread hole 64 provided in the knife holder 61, and a stop screw 67 is screwed into the thread hole 66 provided in the presser leg 12.

Figure 7:
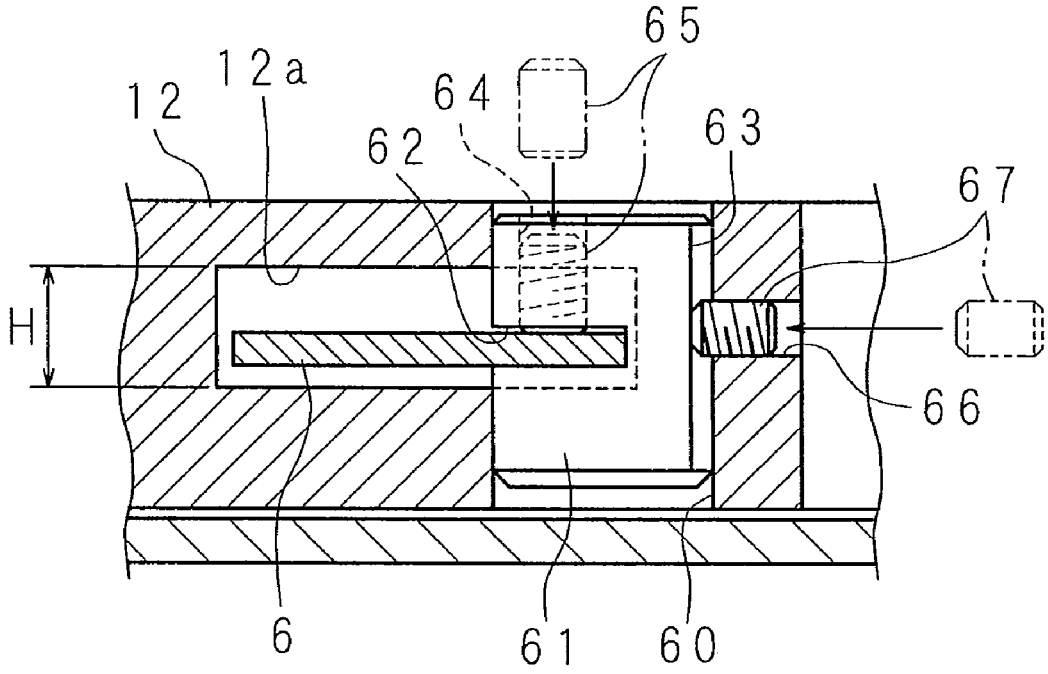
FIG. 7 is an explanatory view showing a state where a knife holder is fixed.

FIG. 7 is an explanatory view showing a state where the knife holder 61 is fixed. As shown in FIG. 7, the stop screw 67 has a flat leading end portion. The knife holder 61 fitted in the guide hole 60 can be fixed so as to be immovable in a vertical direction by fastening the stop screw 67 screwed into the thread hole 66, and pressing the flat leading end portion of the stop screw 67 against the knife holder 61.

The stop screw 67 comes into contact with the flat portion 63 of the knife holder 61, and positions the knife holder 61 in the peripheral direction thereof. At this time, the retention groove 62 provided in the knife holder 61 is open toward the inner side of the window hole 12*a* provided in the presser leg 12. The plate-shaped fixed knife 6 is held by the knife holder 61 by inserting the fixed knife 6 into the window hole 12*a* from the outer side of the presser leg 12 as shown by an arrow in FIG. 6, inserting the fixed knife 6 into the retention groove 62 which is open to the inner side of the window hole 12*a*, and fastening the stop screw 65 screwed into the thread hole 64. The stop screw 65 has a flat leading end portion in the same manner as the stop screw 67. The fixed knife 6 inserted into the retention groove 62 can be firmly fixed and held to the knife holder 61 by fastening the stop screw 65 screwed into the thread hole 64 and pressing the flat leading end portion of the stop screw 65 against the upper surface of the fixed knife 6.

The fixed position of the fixed knife 6 as mentioned above can be adjusted in a vertical direction according to a movement of the knife holder 61 within the guide hole 60, by loosening the stop screw 67 from a diagonally forward side of the presser leg 12 so as to cancel the fixation of the knife holder 61. The fixed knife 6 after finishing the position adjustment can be fixed by fastening the stop screw 67. The position of the fixed knife 6 can be adjusted within a range of a height H (refer to FIG. 7) of the window hole 12*a* provided in the presser leg 12. Further, the knife holder 61 is moved in a state where a position in a radial direction thereof is constrained by the guide hole 60, and a position in the peripheral direction thereof is constrained by the flat portion 63. Accordingly, the position of the fixed knife 6 can be adjusted in the vertical direction without generating any attitude change.

The loosening and fastening operations of the stop screw 67 which are necessary for adjusting the position of the fixed knife 6 can be executed from the diagonally forward side of the presser leg 12. Further, the base portion of the fixed knife 6 protrudes to the outer side of the presser leg 12 as shown in FIGS. 4 and 5, and the vertical movement of the knife holder 61 in a state where the stop screw 67 is loosened can be executed by gripping the protruding base portion of the fixed knife 6. As mentioned above, in the presser foot 1 according to the present invention, it is possible to easily and securely change the vertical position of the fixed knife 6 attached to the presser leg 12 with the operation from the outer side of the presser foot 1.

The movable knife 7 is held by a knife holder 70 on a side which is away from a blade portion 7*a* provided in one end in a longitudinal direction thereof, and is supported by a support table 71 via the knife holder 70 so as to be rotatable about an axis in a vertical direction. The support table 71 is coupled to a drive mechanism (not shown) in the inner portion of the sewing machine arm 2 via a power transmission bracket 72 provided in such a manner as to surround the leading end portion of the sewing machine arm 2, as shown in FIG. 4, and is oscillated around the presser bar 10 by a drive of the drive mechanism.

The movable knife 7 structured as mentioned above is set in a state where the one end provided with the blade portion 7*a* as a head is inserted to the window hole 13*a* provided in the right presser leg 13, as shown by an arrow in FIG. 6, and the blade portion 7*a* protruding toward the left presser leg 12 is overlapped with the upper surface of the fixed knife 6. The movable knife 7 set as mentioned above reciprocates in a lateral direction in correspondence to an oscillation of the support table 71 under constraint within the window hole 13*a*. The blade portion 7*a* of the movable knife 7 is pushed downward by a spring force of a coil spring 73 which is interposed in a support portion of the knife holder 70, and is pressed against the upper surface of the fixed knife 6. With this pressing, the movable knife 7 reciprocates in a state of slidably coming into contact with the upper side of the fixed knife 6, and cuts the ends of the fabrics led in a state of being aligned with each other between the presser legs 12 and 13 as mentioned above.

In the presser foot 1 according to the present invention, since it is possible to adjust the vertical position of the fixed knife 6 as mentioned above, and the cut position of the fabric on the upper surface of the needle plate 4 is changed by this adjustment, it is possible to prevent the sewing defect which occurs in correspondence to the kind of the fabric at a time of seaming, as mentioned above.

As mentioned above, it is possible to easily adjust the vertical position of the fixed knife 6 with the operation in the outer side of the presser foot 1. Accordingly, for example, in a case where the sewing work is executed while changing the kind of the fabric, it is possible to always seam the fabric under a proper condition by carrying out a trial sewing to search the occurrence state of the sewing defect and then adjusting the vertical position of the fixed knife 6 in correspondence to the search result.

The movable knife 7 is pressed to the fixed knife 6 by the spring force of the coil spring 73, and can move in a manner so as to track the adjustment of the vertical position of the fixed knife 6 against the spring force of the coil spring 73, and therefore, the fabric is cut by the reciprocating movement of the movable knife 7 without trouble. If necessary, it is possible to adjust the spring force of the coil spring 73 so as to change the slidable contact strength with the fixed knife 6.

As is apparent from the detailed description mentioned above, in the presser foot according to the present invention, and the sewing machine provided with the presser foot, the position adjusting unit capable of adjusting the vertical position of the fixed knife attached to the one presser leg is provided, and the vertical position of the fixed knife is adjusted in correspondence to the kind of the fabric, therefore, it is possibly to easily seam the fabric without generating any sewing defect caused by the excess or deficiency of the overlapped width.

As this description may be embodied in several forms without departing from the spirit of essential characteristics thereof, the present embodiment is therefore illustrative and not restrictive, since the scope is defined by the appended claims rather than by the description preceding them, and all changes that fall within metes and bounds of the claims, or equivalence of such metes and bounds thereof are therefore intended to be embraced by the claims.

What is claimed is:

1. A presser foot of a sewing machine comprising:

two presser legs provided on lateral sides of a needle drop position of the sewing machine, and pressing a fabric on a needle plate from above;

a fixed knife attached to one presser leg;

a movable knife held by the other presser leg and reciprocating while slidably coming into contact with an upper portion of the fixed knife; and a position adjusting unit adjusting an attached position of the fixed knife in a vertical direction, wherein the presser foot cuts an end of the fabric rising on the needle plate and being led between the two presser legs at a contact position between the movable knife and the fixed knife, and the position adjusting unit is provided with:

a guide hole passing through the one presser leg in a vertical direction thereof;

a knife holder holding the fixed knife and slidably fitted in the guide hole; and a stop screw fixing the knife holder at a desired position of the guide hole.

2. The presser foot according to claim 1, wherein the knife holder is a tubular body, and has a flat portion in a peripheral direction thereof, the stop screw has a flat end portion, and the knife holder is fixed by pressing the flat end portion of the stop screw against the flat portion of the knife holder.

3. The presser foot according to claim 2, wherein the knife holder has:

a retention groove retaining the fixed knife at a peripheral position which does not overlap the flat portion; and a thread hole reaching the retention groove, and provided in an axial one end of the knife holder, and the fixed knife is held by inserting the fixed knife in the retention groove and fastening the stop screw screwed in the thread hole.

4. The presser foot according to claim 1, wherein the stop screw is screwed in a thread hole provided in the one presser leg.

5. The presser foot according to claim 1, wherein the one presser leg has a hole into which the fixed knife is inserted, and the attached position of the fixed knife is adjusted in a range of the hole.

6. The presser foot according to claim 1, wherein the movable knife is pushed to the fixed knife by a spring force.

7. A sewing machine used for feeding two fabrics to a needle drop position on a sewing machine bed while overlapping up and down from respective ends of the fabrics over a predetermined width, and seaming the fabrics, comprising:

a needle plate provided on the sewing machine bed; and the presser foot as defined in claim 1 for pinching the fabrics with the needle plate.

* * * * *